US008777063B2

(12) United States Patent
Beebe

(10) Patent No.: US 8,777,063 B2
(45) Date of Patent: Jul. 15, 2014

(54) SYSTEM AND METHOD FOR RELEASABLY COUPLING A FLUID DISPENSER TO A DISPENSING SYSTEM

(75) Inventor: W. Scott Beebe, Berkley, MA (US)

(73) Assignee: Fishman Corporation, Hopkinton, MA (US)

( * ) Notice: Subject to any disclaimer, the term of this patent is extended or adjusted under 35 U.S.C. 154(b) by 38 days.

(21) Appl. No.: 13/432,264

(22) Filed: Mar. 28, 2012

(65) Prior Publication Data

US 2012/0252242 A1 Oct. 4, 2012

Related U.S. Application Data

(60) Provisional application No. 61/468,239, filed on Mar. 28, 2011.

(51) Int. Cl.
*B67D 7/06* (2010.01)

(52) U.S. Cl.
USPC ..... 222/181.3; 222/1; 222/63; 222/180; 222/333

(58) Field of Classification Search
USPC ..... 222/1, 52, 63, 180, 181.3, 325–327, 222/386, 333; 439/190
See application file for complete search history.

(56) References Cited

U.S. PATENT DOCUMENTS 4,059,110 A * 11/1977 Wuthrich et al. ..... 604/135
4,326,517 A * 4/1982 Whitney et al. ..... 604/155
5,021,046 A * 6/1991 Wallace ..... 604/97.03
5,449,345 A * 9/1995 Taylor et al. ..... 604/100.03
6,341,719 B2 1/2002 Villa
6,743,205 B2 * 6/2004 Nolan et al. ..... 604/154
7,150,724 B2 * 12/2006 Morris et al. ..... 604/131
7,686,789 B2 * 3/2010 Nemoto et al. ..... 604/246
2004/0210192 A1 * 10/2004 Degentesh et al. ..... 604/151
2007/0191787 A1 * 8/2007 Lim et al. ..... 604/246
2010/0094208 A1 4/2010 Branchetti

FOREIGN PATENT DOCUMENTS

DE 20 2005 012870 * 8/2005 ..... G01F 11/04

OTHER PUBLICATIONS

International Search Report and Written Opinion of the International Searching Authority issued in corresponding PCT application No. PCT/US2012/030826, mailed Oct. 31, 2012.

* cited by examiner

*Primary Examiner* — Frederick C Nicolas
*Assistant Examiner* — Bob Zadeh
(74) *Attorney, Agent, or Firm* — Dingman, McInnes & McLane, LLP

(57) ABSTRACT

A system and method for releasably coupling a fluid dispenser to a structure. There is a push to connect-pull to disconnect connector system that has first and second mating connectors. A first connector is mounted to the dispenser and a second connector is mounted to the structure. The connector system accomplishes both mechanical and electrical interconnection between the dispenser and the structure.

12 Claims, 11 Drawing Sheets

SYSTEM AND METHOD FOR RELEASABLY COUPLING A FLUID DISPENSER TO A DISPENSING SYSTEM

CROSS-REFERENCE TO RELATED APPLICATION

This application claims priority of Provisional Application Ser. No. 61/468,239, filed on Mar. 28, 2011, the disclosure of which is incorporated herein by reference.

FIELD

This disclosure relates to the coupling of a fluid dispenser to a fluid dispensing system.

BACKGROUND

There are many situations in which it is desirable to dispense small controlled amounts of fluid in a specific location. One example is the dispensing of an adhesive in an automated production line, such as dispensing a fraction of a milliliter of UV-cured adhesive at the base of the needle of a hypodermic assembly where the adhesive is cured so as to hold the needle in place in the plastic base. There are myriad other situations in which small controlled amounts of fluid need to be dispensed very exactly.

In a production environment it is desirable to have as few interruptions as possible to an automated assembly line. One interruption occurs when a fluid dispenser needs to be refilled or replaced; the line must be halted, the fluid dispenser removed, and a full dispenser placed properly into position. Many assembly lines use several fluid dispensers, each of which needs to hold fluid. This situation leads to the need to stop production fairly frequently so as to replace empty fluid dispensers. It is thus desirable to design the fluid dispensing system in a manner that allows the fluid dispensers to be replaced as quickly as possible.

SUMMARY

In general, one aspect of the disclosure features a system for releasably coupling a fluid dispenser to a structure. There is a push to connect-pull to disconnect connector system that has first and second mating connectors. The fluid dispenser is mounted to a first connector. The second connector is mounted to the structure. The connector system accomplishes releasable mechanical interconnection between the dispenser and the structure, and in most but not all embodiments also accomplishes electrical interconnection between the dispenser and the structure.

Various implementations may include one or more of the following features. The structure may be a fluid dispensing system. The fluid dispenser may comprise a syringe with a dispensing plunger. The fluid dispenser may further comprise a stepper motor operably connected to the syringe and adapted to move the plunger, and wherein the connector system further accomplishes an electrical interconnection between the dispenser and the structure. The fluid dispenser may further comprise a dispenser housing in which the stepper motor is located. The first connector may be mounted to the dispenser housing by one or more straps. The dispenser housing may define an outer shape, and the first connector may define an outer shape that is essentially a mirror image of the outer shape of the dispenser housing, such that the first connector is mounted to the dispenser housing with little space between them.

The first connector may have a connector body that defines a connector face entirely circumscribed by a projecting rim, with the male portion of a male/female electrical connector projecting outward from the connector face and a plurality of post-receiving openings defined in the face on different sides of the projecting electrical connector. The second connector may have a connector body that defines a connector face entirely circumscribed by a plurality of projecting flexible fingers that project outward from the body, wherein the fingers each define a groove near their distal end such that the fingers are adapted to snap over the rim of the first connector and the rim is sized and shaped to be accepted into the grooves, to accomplish a positive locking of the two connectors. The second connector may further define a plurality of posts projecting outwardly from the face and located, sized and shaped to fit into the receiving openings of the first connector when the rim is received in the grooves. The second connector may further define a female portion of the male/female electrical connector, which is located sized and adapted to receive the male electrical connector portion.

In general, another aspect of the disclosure features a method for accomplishing simple and fast coupling and decoupling of a fluid dispenser to a dispensing system. There is a push to connect-pull to disconnect connector system comprising first and second mating connectors, with a first connector adapted to be mounted to the dispenser and a second connector adapted to be mounted to the dispensing system, wherein the connector system accomplishes both mechanical and electrical interconnection between the dispenser and the dispensing system. The dispenser and the dispensing system are mechanically and electrically coupled together by pushing a first connector into the second connector, and are mechanically and electrically decoupled by pulling the first connector away from the second connector.

Various implementations may include one or more of the following features. The fluid dispenser may comprise a syringe with a dispensing plunger, wherein the fluid dispenser further comprises a stepper motor operably connected to the syringe and adapted to move the plunger, and wherein the fluid dispenser further comprises a dispenser housing in which the stepper motor is located. The first connector may be mounted to the dispenser housing by one or more straps. The dispenser housing may define an outer shape and the first connector may define an outer shape that is essentially a mirror image of the outer shape of the dispenser housing such that the first connector is mounted to the dispenser housing with little space between them.

The first connector may have a connector body that defines a connector face entirely circumscribed by a projecting rim, with the male portion of a male/female electrical connector projecting outward from the connector face and a plurality of post-receiving openings defined in the face on different sides of the projecting electrical connector. The second connector may have a connector body that defines a connector face entirely circumscribed by a plurality of projecting flexible fingers that project outward from the body, wherein the fingers each define a groove near their distal end such that the fingers are adapted to snap over the rim of the first connector and the rim is sized and shaped to be accepted into the grooves, to accomplish a positive locking of the two connectors. The second connector may further define a plurality of posts projecting outwardly from the face and located, sized and shaped to fit into the receiving openings of the first connector when the rim is received in the grooves. The second connector may further define a female portion of the male/female electrical connector, which is located sized and adapted to receive the male electrical connector portion.

In general, another aspect of the disclosure features a connector system for accomplishing simple and fast coupling and decoupling of a fluid dispenser to a dispensing system, comprising a push to connect-pull to disconnect connector system comprising first and second mating connectors, with a first connector adapted to be mounted to the dispenser and a second connector adapted to be mounted to the dispensing system, wherein the connector system accomplishes both mechanical and electrical interconnection between the dispenser and the dispensing system. The first connector is mounted to the dispenser such that it lies against a portion of the dispenser, the mounting accomplished by one or more straps that are coupled to the first connector and encircle the dispenser.

Various implementations may include one or more of the following features. The fluid dispenser may comprise a syringe with a dispensing plunger, wherein the fluid dispenser further comprises a stepper motor operably connected to the syringe and adapted to move the plunger, and wherein the fluid dispenser further comprises a housing for the stepper motor. The dispenser housing may define an outer shape and the first connector may define an outer shape that is essentially a mirror image of the outer shape of the dispenser housing such that the first connector is mounted to the dispenser housing with little space between them. The first connector may have a connector body that defines a connector face entirely circumscribed by a projecting rim, with the male portion of a male/female electrical connector projecting outward from the connector face and a plurality of post-receiving openings defined in the face on different sides of the projecting electrical connector. The second connector may have a connector body that defines a connector face entirely circumscribed by a plurality of projecting flexible fingers that project outward from the body, wherein the fingers each define a groove near their distal end such that the fingers are adapted to snap over the rim of the first connector and the rim is sized and shaped to be accepted into the grooves, to accomplish a positive locking of the two connectors. The second connector may further define a plurality of posts projecting outwardly from the face and located, sized and shaped to fit into the receiving openings of the first connector when the rim is received in the grooves. The second connector may further define a female portion of the male/female electrical connector, which is located sized and adapted to receive the male electrical connector portion. The fluid may be a viscous adhesive.

DETAILED DESCRIPTION

Figure 1:
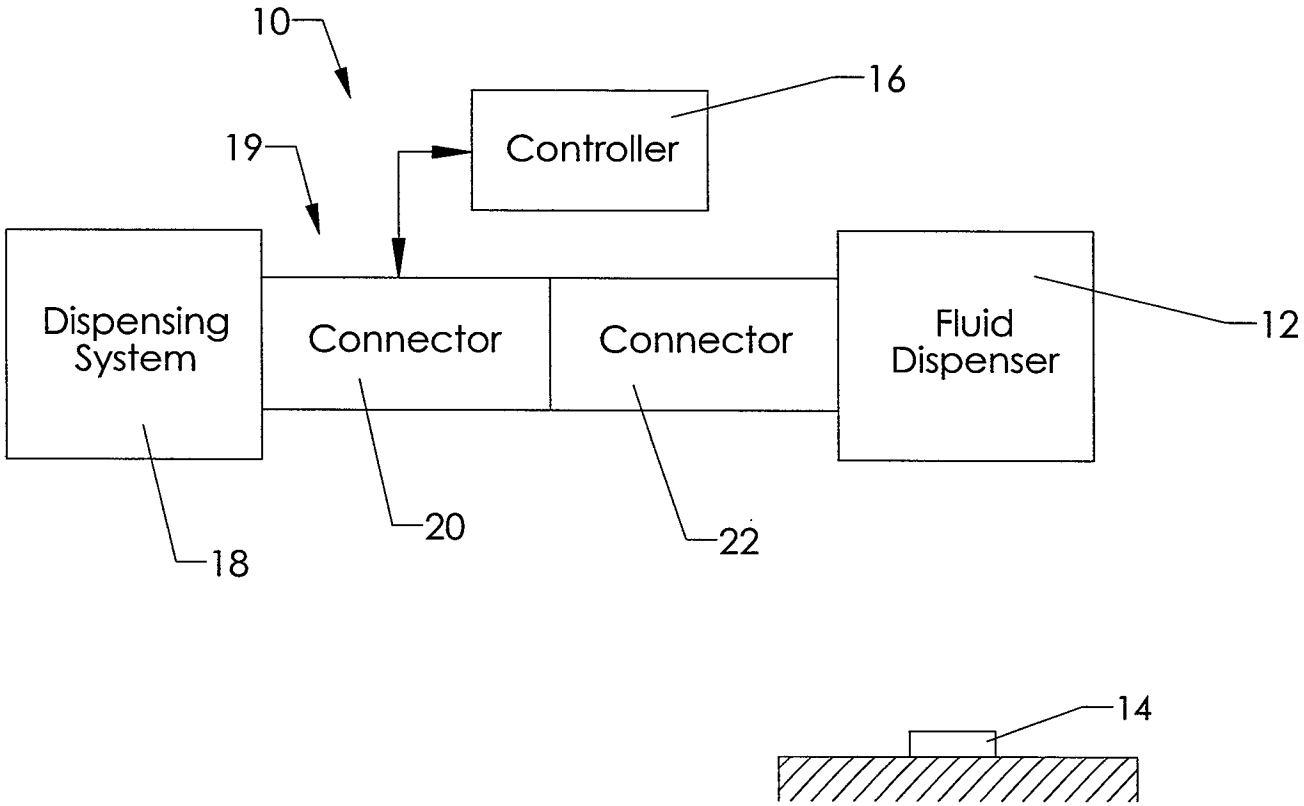
FIG. 1 is a schematic view of a system for releasably coupling a fluid dispenser to a dispensing system.

The embodiments depicted in the drawings accomplish a system that releasably couples an automated dispenser for a liquid adhesive to another structure. As one example the dispenser can be coupled to an automation platform that is automatically moved (typically in two, three or six degrees of freedom) by a control system. The platform can be part of an adhesive dispensing system. The coupling system uses a two part push to connect-pull to disconnect connector structure or system that in most embodiments accomplishes both a mechanical and an electrical interconnection of the fluid dispenser to the dispensing system. The dispensing system carries one connector, and the other connector is coupled to the fluid dispenser. The connector system allows the dispenser to be removed from the dispensing system simply by pulling the dispenser off of the dispensing system. Since the electrical control signals and power to operate the dispenser are provided to the dispenser through the connector, there are no separate or additional control or power wires or cables connected to the fluid dispenser. Thus the dispenser with mounted connector can be removed from the system without the need to unplug or otherwise handle a separate cable running to the dispenser. The coupling disclosed herein can be used for dispensers for fluids other than adhesives. Typically but not necessarily the dispensers are used in automated manufacturing operations.

System 10 for releasably coupling a fluid dispenser to a structure is shown in FIG. 1. Fluid dispenser 12 is adapted to dispense a controlled amount of fluid onto structure 14. In one example, the fluid is a viscous adhesive and dispenser 12 is adapted to dispense a very carefully defined amount of fluid in a defined location or locations of structure 14. Dispensing system 18 may be fixed, or may be a movable platform that can be moved in one or more of the X, Y and Z directions, and possibly in up to six degrees of freedom, as is known in the field.

Controller 16 controls operation of fluid dispenser 12. Controller 16 can be programmed, for example using a programmable logic controller (PLC) or over a network (not shown). Fluid dispenser 12 operates to dispense the fluid; in one non-limiting embodiment the dispensing is accomplished with a stepper motor. Dispenser energizing signals are provided via connector 22 that is permanently or semi-permanently connected to dispenser 12. Connector 22 is releasably, and mechanically and electrically, coupled to connector 20. Connector 20 is permanently or semi-permanently coupled to dispensing system 18. Connectors 20 and 22 can be the two mating portions of a two-part mechanical and electrical push-pull type connector system 19.

Results of system 10 are that an empty fluid dispenser can be removed from the dispensing system simply by pulling the dispenser away from the dispensing system to dislodge connector 22 from connector 20. A replacement fluid dispenser filled with a pre-determined amount of fluid can then be added simply by pushing the connector 22 that is mounted to the filled fluid dispenser onto connector 20. This allows quick and simple replacement without the need to loosen any brackets or other hardware that is typically used to couple a fluid dispenser to a fluid dispensing system.

Figure 2:
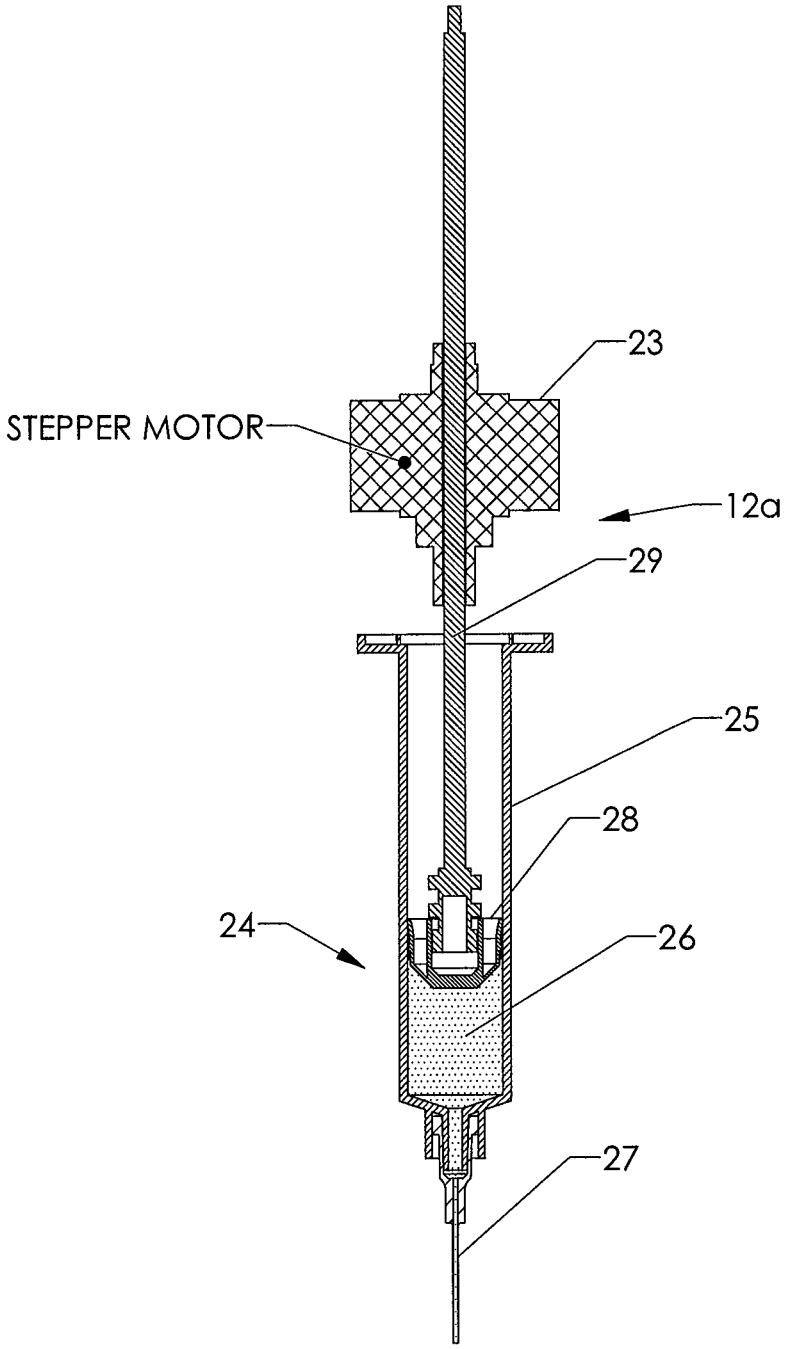
FIG. 2 is a schematic partially cross-sectional view of a fluid dispenser.

An example of a fluid dispenser 12*a* is shown in FIG. 2. Stepper motor 23 is adapted to move output shaft (e.g., lead screw) 29 up and down in a series of very small, carefully controlled steps. Plunger 28 is coupled to the distal end of shaft 29 and fits within chamber 25 of dispensing syringe 24. Fluid 26 fills the volume of syringe 24 between plunger 28 and the distal tip of dispensing nozzle (e.g., needle) 27. With this arrangement, when stepper motor 23 is incremented one step, a very small amount of fluid is dispensed from tip 27.

In one non-limiting example, there are a series of three dispense guns that can each operate syringes such as that shown in FIG. 2, with volumes of 3, 5, 10 and 30 ml. One dispense gun (the "SDAV" gun) has a stepper motor with a travel of 0.000125" per step. A second gun (the "MDAV" gun) has a stepper motor with a travel of twice that of the SDAV or 0.00025" per step. A third gun (the "LDAV" gun) has a stepper motor with a travel of twice that of the MDAV, or 0.0005" per step. The information below indicates the volume per step for each of the four syringe volumes, for each of these three dispense gun models.

SDAV Dispensing Gun 1 step with a 3 cc syringe barrel will yield 0.00023 cc of fluid dispensed.

1 step with a 5 cc syringe barrel will yield 0.00039 cc of fluid dispensed.

1 step with a 10 cc syringe barrel will yield 0.00065 cc of fluid dispensed.

1 step with a 30 cc syringe barrel will yield 0.00129 cc of fluid dispensed.

MDAV Dispensing Gun 1 step with a 3 cc syringe barrel will yield 0.00045 cc of fluid dispensed.

1 step with a 5 cc syringe barrel will yield 0.00079 cc of fluid dispensed.

1 step with a 10 cc syringe barrel will yield 0.00131 cc of fluid dispensed.

1 step with a 30 cc syringe barrel will yield 0.00257 cc of fluid dispensed.

LDAV Dispensing Gun 1 step with a 3 cc syringe barrel will yield 0.00090 cc of fluid dispensed.

1 step with a 5 cc syringe barrel will yield 0.00158 cc of fluid dispensed.

1 step with a 10 cc syringe barrel will yield 0.00261 cc of fluid dispensed.

1 step with a 30 cc syringe barrel will yield 0.00514 cc of fluid dispensed.

Figure 3:
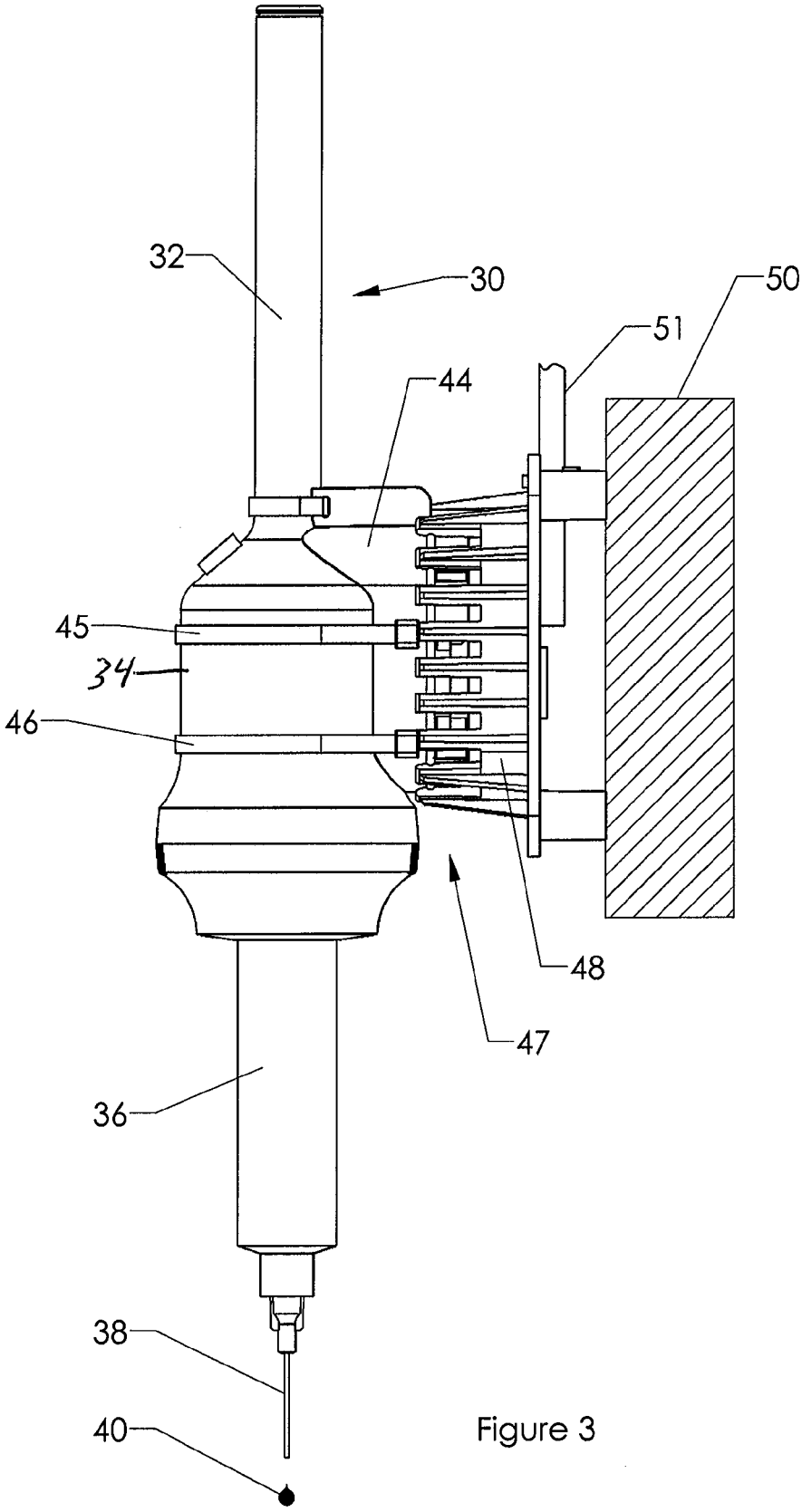
FIG. 3 shows a fluid dispenser and a connector system.
Figure 4:
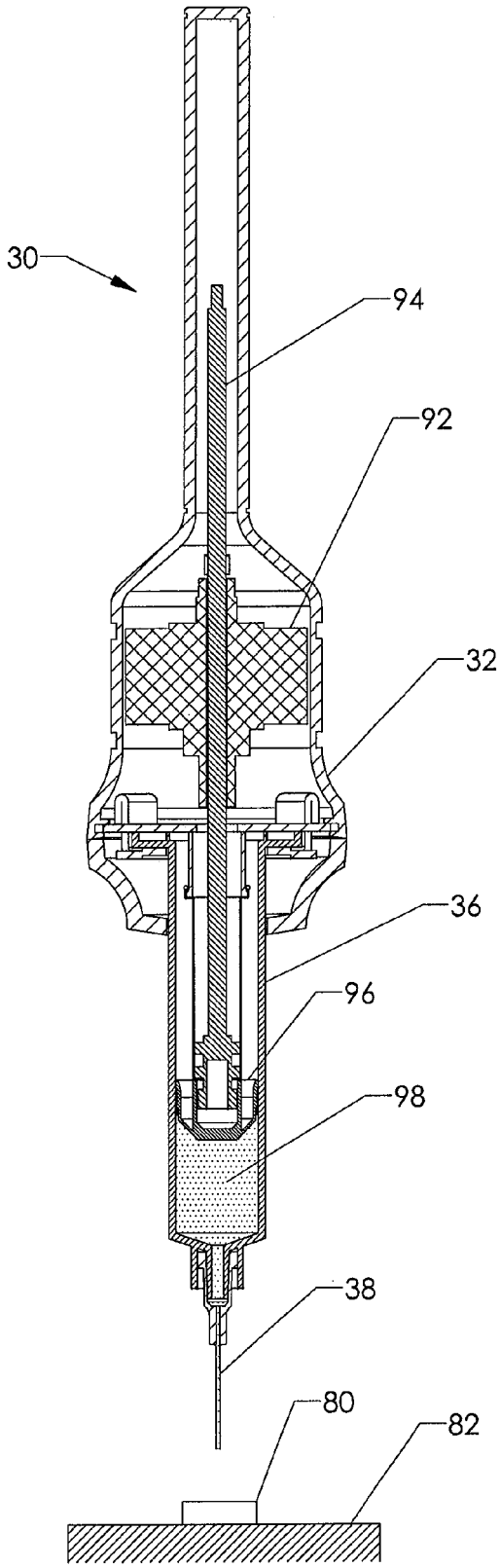
FIG. 4 is a cross-sectional view of the fluid dispenser of FIG. 3.
Figure 5:
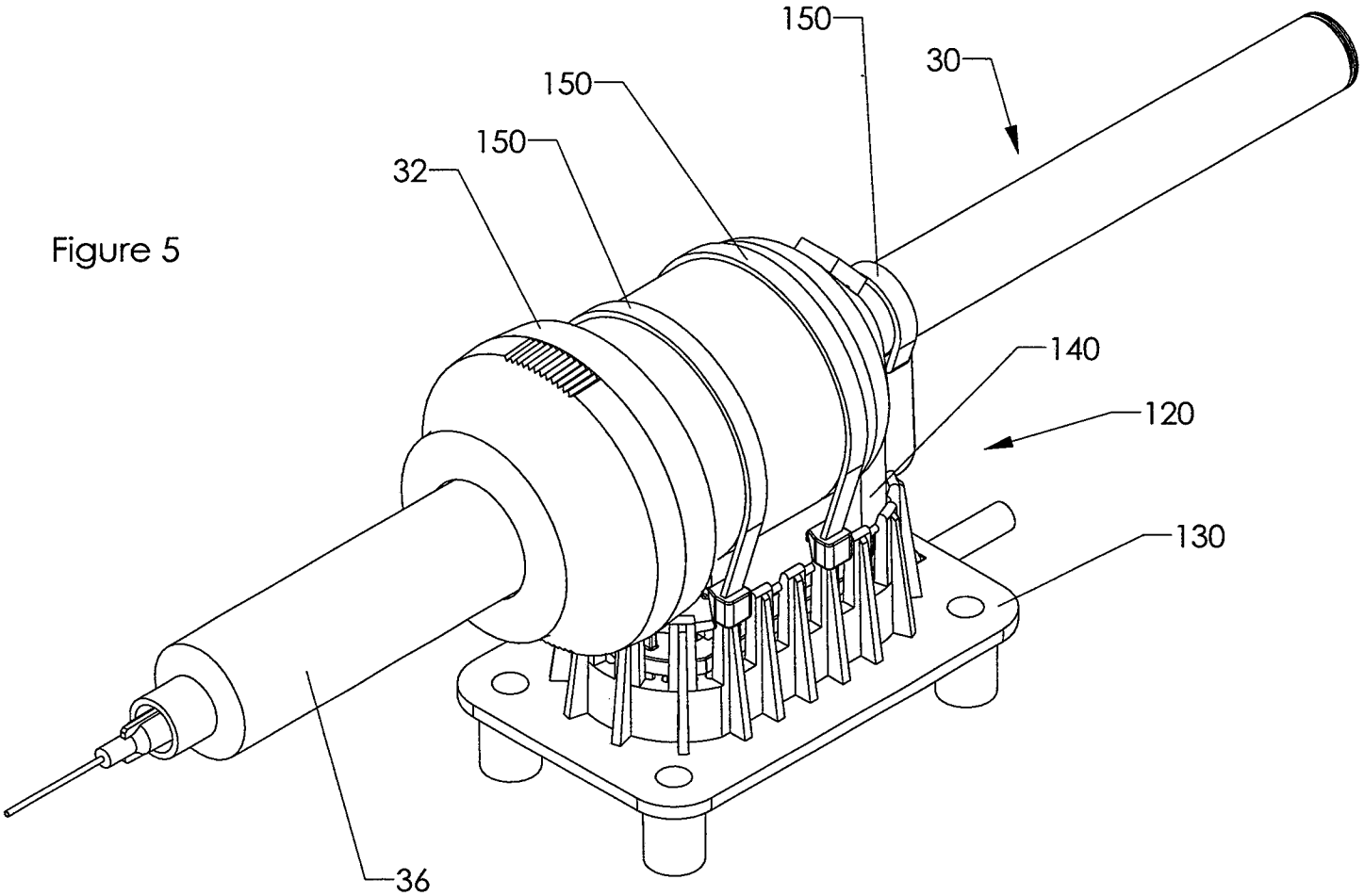
FIG. 5 is a perspective view of a fluid dispenser and two connectors of a connector system.
Figure 6:
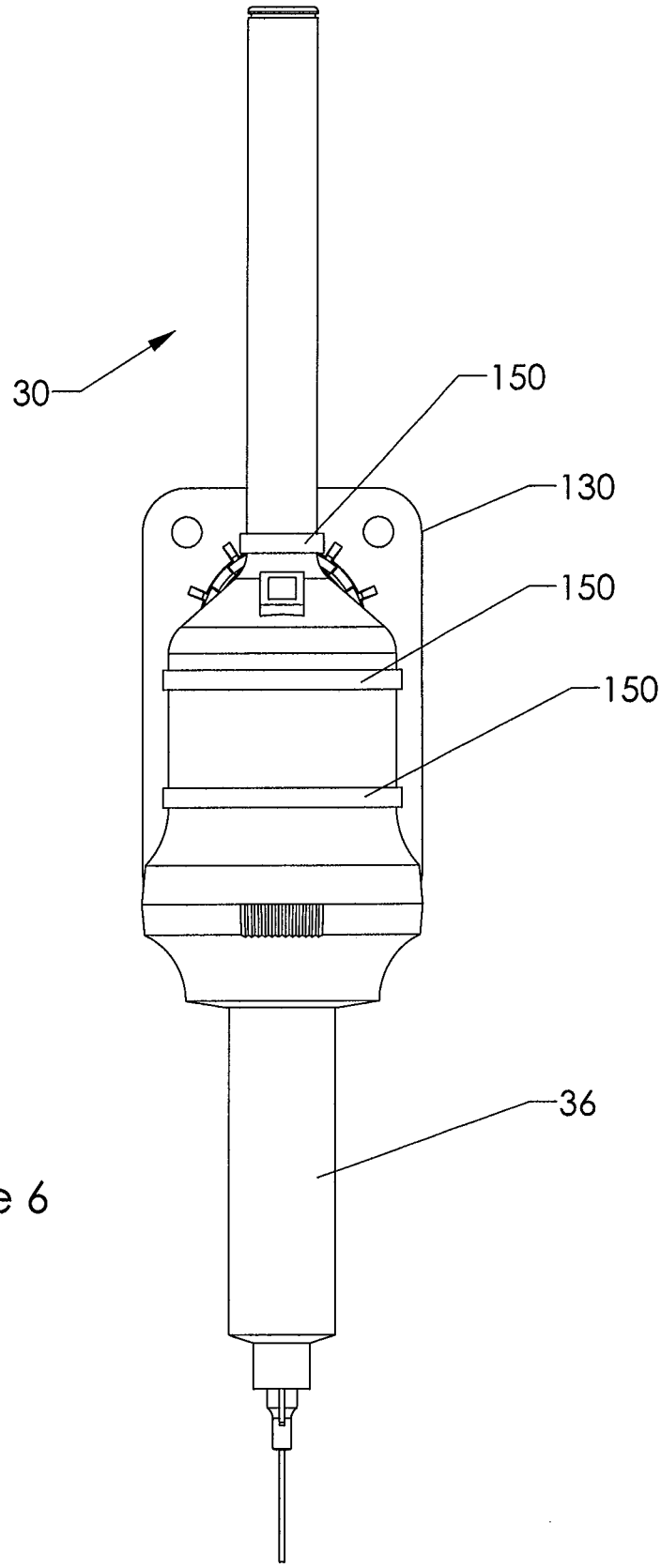
FIG. 6 is a front view of the fluid dispenser and connectors of FIG. 5.
Figure 8:
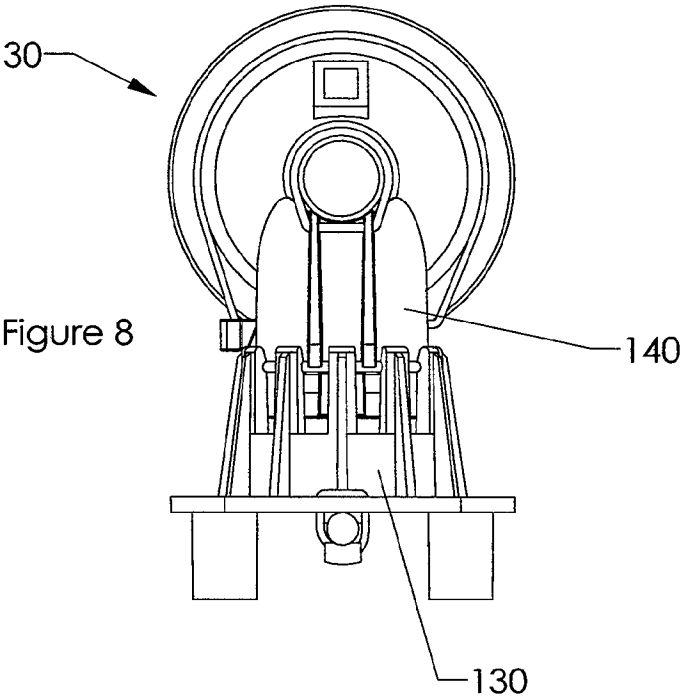
FIG. 8 is the other end view of the fluid dispenser and connectors of FIG. 5.
Figure 7:
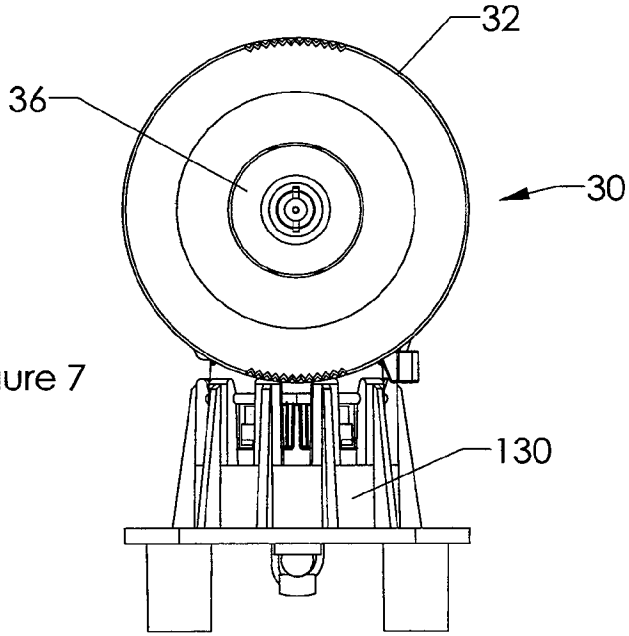
FIG. 7 is an end view of the fluid dispenser and connectors of FIG. 5.
Figure 9:
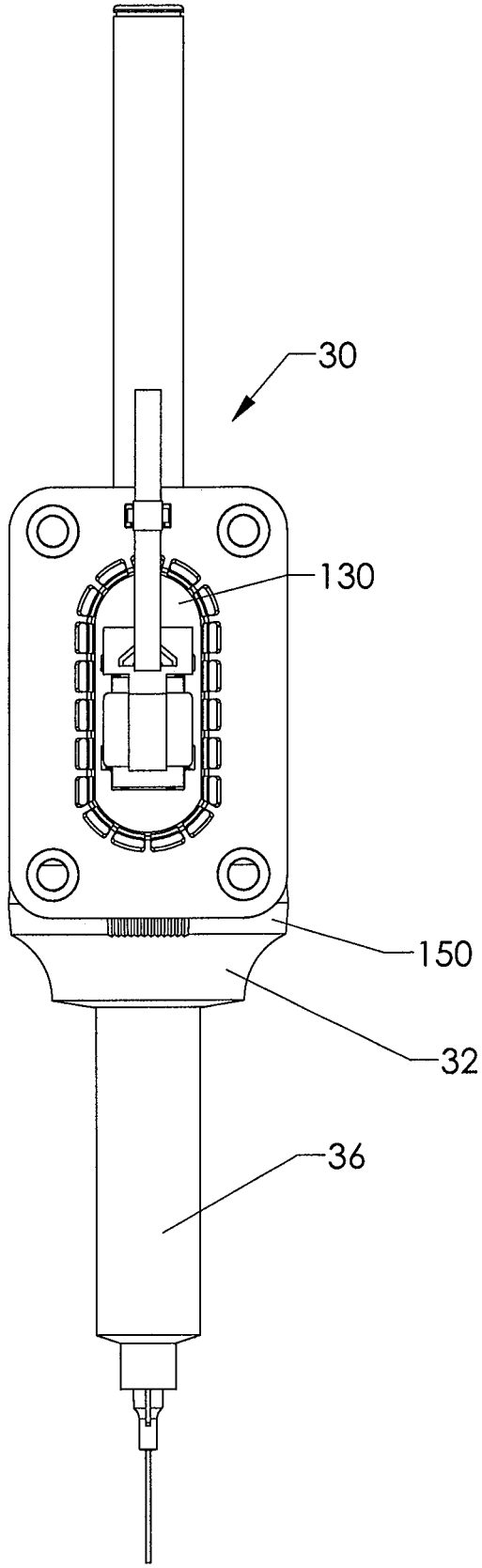
FIG. 9 is a rear view of the fluid dispenser and connectors of FIG. 5.
Figure 10:
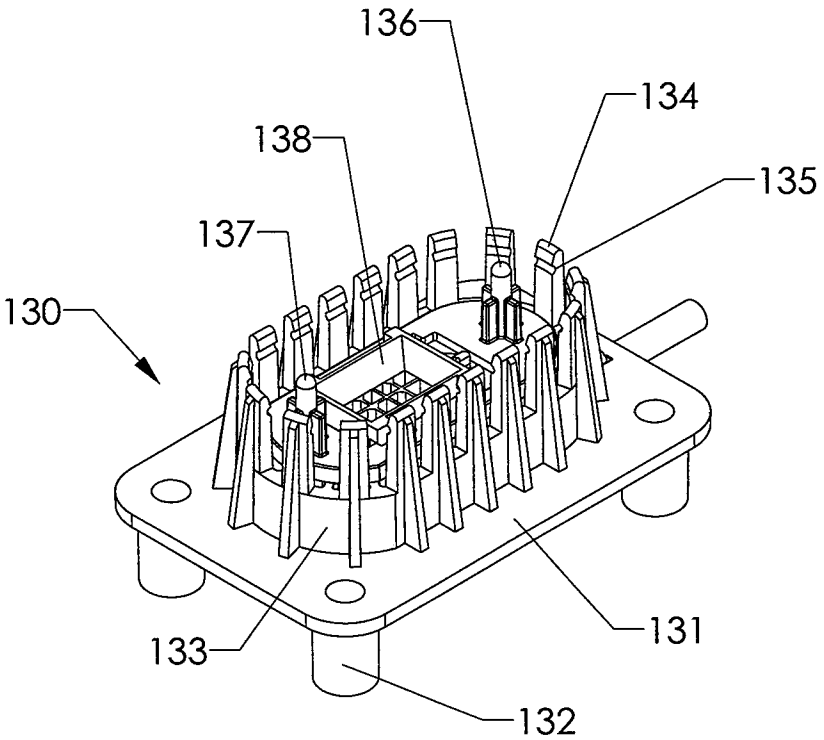
FIG. 10 is an enlarged perspective view of one connector of a connector system.
Figure 11:
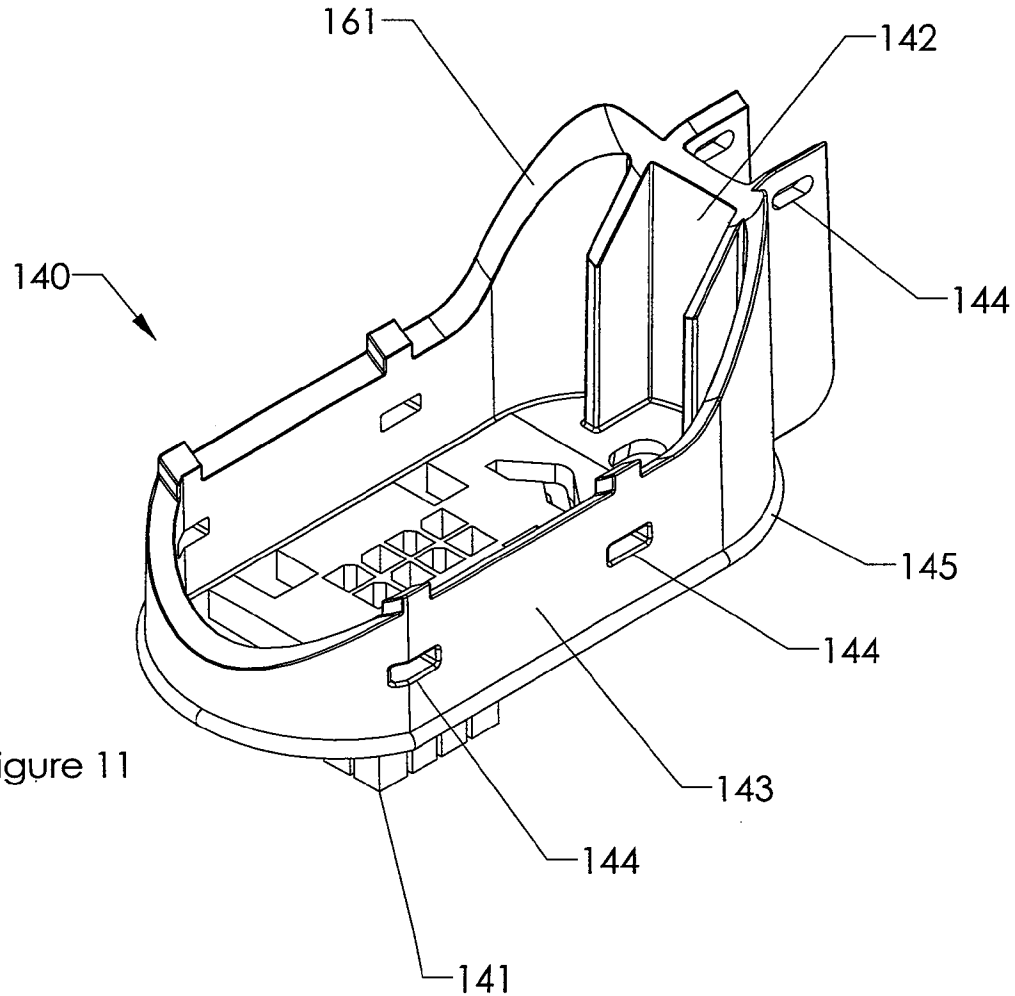
FIG. 11 is an enlarged perspective view of a second connector of a connector system.
Figure 12:
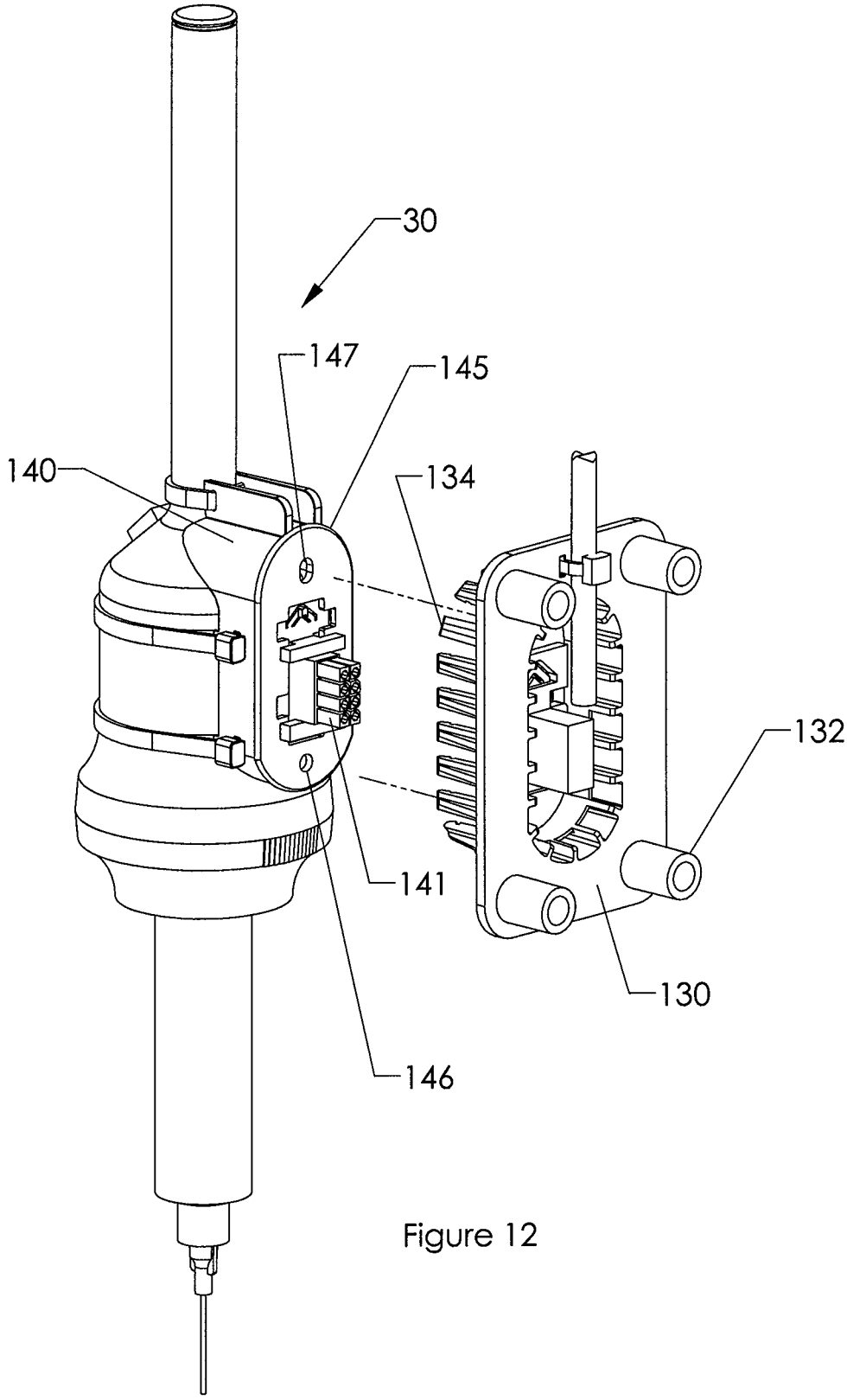
FIG. 12 shows the connectors of FIGS. 10 and 11 before they are mechanically and electrically engaged with each other.

Additional examples of fluid dispensers are depicted in FIGS. 3-12. Fluid dispenser 30, FIGS. 3 and 4, has housing 32 that contains a stepper motor 92 of the type described above. Syringe 36 with dispensing tip 38 is coupled to the stepper motor output shaft 94. FIG. 3 shows drop 40 being dispensed from tip 38. Drop 40 is dispensed onto structure 80 located on table 82. Two-part mechanical and electrical connector system 47 is used to mechanically and electrically couple dispenser 30 to structure 50 that is part of the dispensing system. Connector system 47 comprises first connector 48 that is mechanically coupled to structure 50. Electrical continuity is accomplished via cable 51 that terminates at electrical contacts (not shown) that are part of connector 48. Second, mating connector 44 is mechanically coupled to housing 32 via straps 45 and 46 that encircle portion 34 and mechanically engage with (pass through) connector portion 44. Power and control signals are provided to the dispenser from a controller via mating electrical contacts built into connectors 44 and 48.

FIGS. 5-12 show additional details of a specific embodiment of two-part connector system 120. Connector system 120 comprises one connector 130 that is adapted to be fixed to a dispensing system via posts 132 that project from base 131. Machine screws or other fasteners fit through posts 132. The other connector 140 is fixed to dispenser housing 32 via strap(s) 150; one, two or more such straps may be used, two being shown here. Body 143 of connector 140 defines extension portion 142 that tightly couples to housing 32; surface 161 is shaped to conform to the shape of the outer surface of housing 32 against which it lies, so that connector 140 is almost effectively integral with housing 32. Slots 144 allow straps 150 to pass through body 143; there are one or more (typically, two) slots for each strap. Connectors 130 and 140 may each be unitary; they may be molded from a plastic material such as polyamide 6, 33% glass filled nylon.

Connector 130 further includes projecting flexible fingers 134 that project from body 133. Fingers 134 each define a groove 135 near the distal end. The fingers snap over rim 145 of connector 140 and rim 145 is accepted into grooves 135, to accomplish a positive locking of the two connectors. Fingers 134 circumscribe the entire connector body to define a receptacle for rim 145. Because fingers 134 are made of a plastic material that has some give, and because the fingers have free distal ends, the fingers are sufficiently flexible such that they release rim 145 when connector 140 is pulled away from connector 130. Posts 136 and 137 fit into receiving openings 146 and 147. Male electrical connector portion 141 fits into female electrical connector receiving portion 138, which has sloped sidewalls that guide portion 141 into portion 138. The posts and these guide features help to allow a blind connection of the two connector halves.

Connector system 120 thus accomplishes both mechanical and electrical connection between the dispenser and the dispensing system in a push on-pull off system that can be operated with one hand and without direct sight of the connection location on the dispense system.

The connector system herein could be used to couple fluid dispensers other than syringes. For example the dispenser could be a dispense gun or other device that is electrically operated to dispense a controlled amount of fluid. As another alternative, the fluid dispenser could be a dispense valve, in which case there may not need to be an electrical connection accomplished by the connector system. A further alternative to the fluid dispenser could be a dispense tip such as a needle or other orifice; the connector could be used to hold the tubing leading to the dispense tip and the tip itself, to allow rapid attachment and detachment of them for replacement.

A number of embodiments and options have been described herein. Modifications may be made without departing from the spirit and scope of the invention. For example, the Accordingly, other embodiments are within the claims.

What is claimed is:

1. A system for releasably coupling a fluid dispenser to a structure, comprising:

a push to connect-pull to disconnect connector system comprising a first and a second mating connectors, wherein the first connector is adapted to be mounted to the dispenser, and the second connector is adapted to be mounted to the structure;

wherein the connector system accomplishes a releasable mechanical interconnection between the dispenser and the structure; and wherein the fluid dispenser further comprises a stepper motor operably connected to a syringe and adapted to move a plunger, and wherein the connector system further accomplishes an electrical interconnection between the dispenser and the structure;

the first connector has a connector body that defines a connector face entirely circumscribed by a projecting rim, with a male portion of a male/female electrical connector projecting outward from the connector face and a plurality of openings defined in the face on different sides of the projecting electrical connector;

wherein the second connector has a connector body that defines a connector face entirely circumscribed by a plurality of projecting flexible fingers that project outward from the body, wherein the fingers each define a groove near distal end of the fingers such that the fingers are adapted to snap over the rim of the first connector and the rim is sized and shaped to be accepted into the grooves, to accomplish locking of the first and second connectors;

wherein the second connector further defines a plurality of posts projecting outwardly from the face and located, sized and shaped to fit into the plurality of openings of the first connector when the rim is received in the grooves; and wherein the second connector further defines a female portion of the male/female electrical connector, which is located sized and adapted to receive the male electrical connector portion.

2. The system of claim 1 wherein the fluid dispenser further comprises a dispenser housing in which the stepper motor is located.

3. The system of claim 2 wherein the first connector is mounted to the dispenser housing by one or more straps.

4. The system of claim 2 wherein the dispenser housing defines an outer shape and the first connector defines an outer shape that substantially mirrors the outer shape of the dispenser housing.

5. A method for accomplishing simple and fast coupling and decoupling of a fluid dispenser to a dispensing system, comprising:

providing a push to connect-pull to disconnect connector system comprising a first and a second mating connectors, with a first connector adapted to be mounted to the dispenser and a second connector adapted to be mounted to the dispensing system, wherein the connector system accomplishes both mechanical and electrical interconnection between the dispenser and the dispensing system;

mechanically and electrically coupling the dispenser and the dispensing system together by pushing a first connector into the second connector; and mechanically and electrically decoupling the dispenser from the dispensing system by pulling the first connector away from the second connector;

the first connector has a connector body that defines a connector face entirely circumscribed by a projecting rim, with a male portion of a male/female electrical connector projecting outward from the connector face and a plurality of openings defined in the face on different sides of the projecting electrical connector;

wherein the second connector has a connector body that defines a connector face entirely circumscribed by a plurality of projecting flexible fingers that project outward from the body, wherein the fingers each define a groove near distal end of the fingers such that the fingers are adapted to snap over the rim of the first connector and the rim is sized and shaped to be accepted into the grooves, to accomplish locking of the first and second connectors;

wherein the second connector further defines a plurality of posts projecting outwardly from the face and located, sized and shaped to fit into the plurality of openings of the first connector when the rim is received in the grooves; and wherein the second connector further defines a female portion of the male/female electrical connector, which is located sized and adapted to receive the male electrical connector portion.

6. The method of claim 5 wherein the fluid dispenser comprises a syringe with a dispensing plunger, wherein the fluid dispenser further comprises a stepper motor operably connected to the syringe and adapted to move the plunger, and wherein the fluid dispenser further comprises a dispenser housing in which the stepper motor is located.

7. The method of claim 6 wherein the first connector is mounted to the dispenser housing by one or more straps.

8. The method of claim 6 wherein the dispenser housing defines an outer shape and the first connector defines an outer shape that substantially mirrors the outer shape of the dispenser housing.

9. A connector system for accomplishing simple and fast coupling and decoupling of a fluid dispenser to a dispensing system, comprising:

a push to connect-pull to disconnect connector system comprising a first and a second mating connectors, with a first connector adapted to be mounted to the dispenser and a second connector adapted to be mounted to the dispensing system, wherein the connector system accomplishes both mechanical and electrical interconnection between the dispenser and the dispensing system;

wherein the first connector is mounted to the dispenser such that the first connector lies against a portion of the dispenser, the mounting accomplished by one or more straps that are coupled to the first connector and encircle the dispenser;

the first connector has a connector body that defines a connector face entirely circumscribed by a projecting rim, with a male portion of a male/female electrical connector projecting outward from the connector face and a plurality of openings defined in the face on different sides of the projecting electrical connector;

wherein the second connector has a connector body that defines a connector face entirely circumscribed by a plurality of projecting flexible fingers that project outward from the body, wherein the fingers each define a groove near distal end of the fingers such that the fingers are adapted to snap over the rim of the first connector and the rim is sized and shaped to be accepted into the grooves, to accomplish locking of the first and second connectors;

wherein the second connector further defines a plurality of posts projecting outwardly from the face and located, sized and shaped to fit into the plurality of openings of the first connector when the rim is received in the grooves; and wherein the second connector further defines a female portion of the male/female electrical connector, which is located sized and adapted to receive the male electrical connector portion.

10. The system of claim 9 wherein the fluid dispenser comprises a syringe with a dispensing plunger, wherein the fluid dispenser further comprises a stepper motor operably connected to the syringe and adapted to move the plunger, and wherein the fluid dispenser further comprises a housing for the stepper motor.

11. The system of claim 10 wherein the dispenser housing defines an outer shape and the first connector defines an outer shape that substantially mirrors the outer shape of the dispenser housing.

12. The system of claim 9 wherein the fluid is a viscous adhesive.

* * * * *